US005269219A

United States Patent [19]

Juvik-Woods

[11] Patent Number: 5,269,219

[45] Date of Patent: Dec. 14, 1993

[54] PALLET DESIGN USING PAPER MATERIALS

[75] Inventor: Harry C. Juvik-Woods, San Rafael, Calif.

[73] Assignee: Damage Prevention Products Inc., Benicia, Calif.

[21] Appl. No.: 38,546

[22] Filed: Mar. 29, 1993

Related U.S. Application Data

[63] Continuation of Ser. No. 635,195, Dec. 26, 1990, abandoned.

[51] Int. Cl.[5] ..... B65D 19/00

[52] U.S. Cl. ..... 108/51.3; 108/56.3

[58] Field of Search ..... 108/51.3, 51.1, 56.3

[56] References Cited

U.S. PATENT DOCUMENTS

| | | | |
|---|---|---|---|
| 2,432,295 | 12/1947 | Donahue | 108/51.3 X |
| 2,446,914 | 8/1948 | Fallert et al. | 108/51.3 |
| 2,503,240 | 4/1950 | Cahners | 108/51.3 |
| 3,661,099 | 5/1972 | Shelor | 108/56.3 X |
| 3,709,161 | 1/1973 | Kauffman | 108/51.3 X |
| 3,982,057 | 9/1976 | Briggs et al. | 108/51.3 X |
| 4,378,743 | 4/1983 | McFarland | 108/56.3 X |
| 5,076,176 | 12/1991 | Clasen | 108/51.3 |

FOREIGN PATENT DOCUMENTS

| | | | |
|---|---|---|---|
| 1131148 | 6/1962 | Fed. Rep. of Germany | 108/51.3 |

*Primary Examiner*—Jose V. Chen
*Attorney, Agent, or Firm*—E. Thomas Wheelock

[57] ABSTRACT

A inexpensive pallet design is described for transporting loads fabricated form paper products consisting of a load-supporting deck, a top cover sheet with tuck tabs that provides a fastening and link to the runners, a bottom sheet glued to the deck that provides a solid surface to attached the runners, and runners spaced apart and at the appropriately height to provide access and maneuverability to the forks or a forklift or handjack. The construction of the pallet being a combination of paper, paperboard, corrugated paper board, honeycomb and adhesive and the fabrication of the pallet reduced to a minimum of parts provides a sufficiently strong yet lightweight support for goods competitive in cost to conventional wood pallets.

13 Claims, 3 Drawing Sheets

PALLET DESIGN USING PAPER MATERIALS

This is a continuation of U.S. Ser. No. 07/635195 filed Dec. 26, 1990, now abandoned.

FIELD OF THE INVENTION

This invention relates is broadly related to the field of pallets that are manufactured from paper and paper materials such as corrugate and honeycomb. These lightweight pallets are used for the load-carrying support of goods used and shipped via various forms of transportation.

BACKGROUND OF THE INVENTION

A pallet is a portable, horizontal, rigid platform used as a base for assembling, storage, stacking, handling and transporting goods as a unit load, often equipped with a superstructure. Conventional pallets are generally constructed of wood made by joining together as set of top and bottom deckboards fastened by nails or staples to a continuous, solid board often called a stringer or stringerboard. The pallet will have openings in the design to accompany fork truck or hand jack equipment to insert their forks between the top deck and bottom deck to lifting the pallet and its load off the floor. Pallets are generally square or rectangle with two-way or four-way entry into the pallet. A typical pallet size is 48 inches by 40 inches, i.e., 48 inch stringer or stringerboard and 40 inch deckboard.

Over Ninety percent (90%) of all pallets used in the United States are made of wood but these wood pallets have several disadvantages. First, labor and material costs involved in producing wooden pallets are relatively high and in recent years these costs have been increasing faster than inflation. As a result of these high costs, wooden pallets are often required to be reused either by the receiver or returned to the supplier which results in higher shipping costs (normally they are returned to the supplier empty). Second, because wood pallets weigh on the average forty (40) pounds this adds to the cost of shipping the load. The shipper is charged based on weight loading of the entire load including the pallet. Likewise due to the weight of the wooden pallet the operator may have difficulty manually moving the pallets. Third, some pallets are damaged during use while others are lost altogether through neglect or pilferage. The repair or disposal of damaged wood pallets adds to their cost. In some industries the typical wooden pallet is used on an average of no more than twice before it must be replaced or repaired. Typically a wood pallet will have four trips or reuses before disposal is necessary and disposal is already a major environmental concern.

Materials other than wood are being used in the design and manufacture of pallets such as metal, plastic and paper. The use of paper materials can be cost competitive to materials such as wood, metal and plastic while at the same time offering benefits that are not available through the use of traditional wood materials. The benefits of using paper materials are several fold. Paper products are lighter than wood, plastic or metal products and when formed into a honeycomb structure have remarkable crush strength. A paper pallet can be composed of four materials—paper sheet, paper honeycomb, paper corrugate and glue. Individually these products have limited, if any, ability to compete with wood products on a cost/benefit basis. However, by combining these materials in an effective design boosts the performance several fold while maintaining cost to similar wood products. Paper products are lightweight and easy to handle. Factory workers prefer working with products because of its light weight and surfaces that are smooth and splinter free. These features help reduce injury and time loss. Since our products have no nails, wood, metal or plastic components, they are biodegradable and can be disposed of without penalty charges or prohibitions from land fills or they can be baled and recycled to paper companies. Because of the ease of working with paper materials and the availability of various honeycomb structures, products can be manufactured in a variety of shapes and sizes to meet our customers' particular requirements. Because of the smooth surfaces and ability to adsorb energy, our products are very effective in reducing shipping damage to products.

The open literature shows several designs that use paper-based materials. Several companies have obtained U.S. patents in the 1970's and 1980's on pallet designs involving the use of paper materials. A summary of those patents is found in the following list:

| U.S. Pat. No. | Inventor | Title |
|---|---|---|
| 3,661,099 | Shelor | Pallet Deck |
| 3,650,459 | Tucker | Pallet Type Shipping Container |
| 3,952,672 | Gordon et al. | Corrugated Disposable Pallet |
| 4,319,530 | Moog | Pallet Having Runners with Displacable Sections |
| 4,790,249 | Webb | Load-Carrying Pallet |

None of these patents discloses a design for a paper pallet that meets the requirements of lightweight yet cost-effective design, and at the same time is capable of supporting relatively heavy loads.

U.S. Pat. No. 3,661,099 to Shelor suggests the use of corrugated board strips glued together perpendicular to the deck surface to form a core that is sandwiched between corrugated board sheets. The core laminate is comprised of multiplicity of planar strips, aligned in spaced, parallel relationship and separated by strips of thin solid sheet material. The deck is supported at corners by wood blocks that are attached to the deck by fasteners in order to function as a to form a pallet structure. The patent suggests that pallets fabricated from corrugate paper board versus a core laminated as suggested by Shelor made the pallets either too weak or too expensive.

U.S. Pat. No. 3,650,459 to Tucker discloses an invention related to the use of corrugated paper board to form a pallet-type shipping container with pallet feet formed of paper corrugate or molded plastic material disposed between the bottom tray of the container and a bottom panel.

U.S. Pat. No. 3,952,672 to Gordon et al. discloses a pallet of foldable material comprising a unitary outer structure folded about and joined to a unitary inner structure for easy assembly and disassembly. Both the inner and outer structures are made from corrugated paper board that connected by tuck tabs thereby requiring no external fastening means. The Gordon patent suffers from the same disadvantages as the prior art pallets noted above. First, the Gordon pallet requires a number of fabrication steps to machine the number of openings, tabs, tucks, etc. required to form the pallet. These fabrication steps add to the cost of the pallet and prevents it from competing on a cost basis with wood pallets. Additionally, the Gordon pallet does not have the necessary crush strength to support a typical wood pallet load of 2000 pounds dynamic loading. Wood pallets can easily handle loads above 2,500 pounds. However, less than ten percent (10%) of all pallet shipments made in the United States are above 2,500 pounds, and only thirty five percent (35%) of all shipments are over 2,000 pounds. Therefore, aA pallet designed to handle loads up to 2,000 pounds can adequately meet sixty five (65%) of all shipments. In order for the prior art pallets noted above to reach loadings of 2,500 pounds it becomes necessary to dramatically alter the structure of the pallet design which in turn increasing its costs and make them non-competitive to traditional wood pallets.

U.S. Pat. No. 4,319,530 to Moog describes a pallet design which does not employ a honeycomb top deck but utilizes a corrugate deck with honeycomb legs to support and provide strength to the pallet design. The Moog patent attempts to underlie with honeycomb pads and runners at least fifty percent (50%) of the surface area of the top deck. By increasing the amount of honeycomb support the pallet relies less on the rigidity of the deck to carry the load in the voids where no honeycomb material exists. However, with the large amount of exposed honeycomb material, the forks of the forklift or hand jack will easily puncture the honeycomb pads thereby reducing its strength and load-bearing capacity. While the patent of Moog attempts to occupy a proportionately greater area beneath the deck to provide loading-bearing support for heavy loads, it limits the space required by the forklift operators to position his fork blades without serious damage caused to the support structure.

U.S. Pat. No. 4,790,249 to Webb discloses a pallet that is also formed by through the use of corrugate and honeycomb materials that is lightweight and capable of supporting relatively heavy loads. Webb attempts to overcome Moog's deficiency by adding a bottom corrugate sheet to sandwich rigid tubular blocks or honeycomb blocks that provide strength to the pallet design and entry by the forks of the forklift. According to Webb, the invention allows the pallet to withstand side-shifting of the pallet when being shifted over the floor by the forklift. In addition, Webb claims the blocks which are not exposed are thereby not weakened by moisture and thus can be used on damp floors. Webb's design still requires that the block provide the load-bearing strength of the pallet and provide little room for the forks of the forklift to maneuver in an out of the pallet very easily. In addition, this design still suffers form the deficiencies of the prior art noted above in that the fabrication of the blocks and incorporation of the blocks into the structure is labor intensive and adds dramatically to the cost of the design.

DESCRIPTION OF THE DRAWINGS

For better understanding of the invention, the accompanying drawings form part of the specification and like numerals and letters refer to like parts wherever they occur.

SUMMARY OF THE INVENTION

Figure 1:
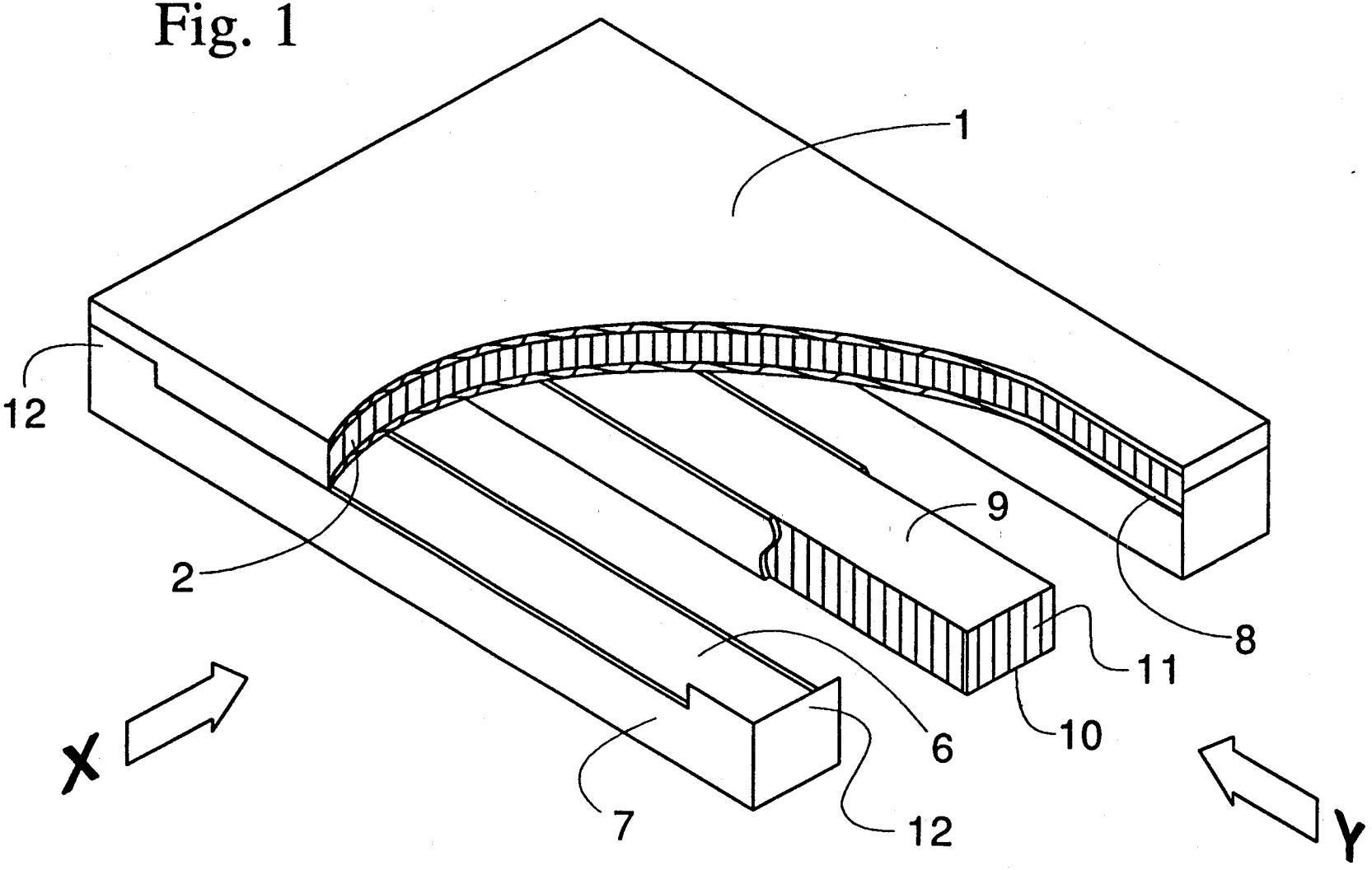
FIG. 1 shows a perspective view of a pallet constructed in accordance with and embodying the present invention with part of the pallets deck broken away and one of the honeycomb runners exposed. This figure displays a two-way entry pallet with honeycomb core runners.

This invention relates to pallets and in particular to a lightweight paper-based pallet which may be used for supporting goods above the floor so that they may be lifted and moved with goods thereon by a forklift or handjack truck. The design teaches construction of a pallet that comprises of a top sheet made from paper corrugate board (i.e., flat sheets consisting of or including two flat paper or card plies adhered to either side of a corrugate or solid cardboard) that wraps around both the top deck fabricated from two face sheets held apart by a honeycomb paper structure and a bottom sheet made form corrugate paper board. The legs or runners of the design are also covered with a corrugate sheet placing the leg or runner in a tray that is adhered to the bottom sheet and connected to the top deck by tabs provide in the top sheet. The interlocking of the top sheet to the trays provides overall design integrity. The legs or runners, trays, sheets and deck are all secured in place by an adhesive.

Pallets according to this invention have several advantages over prior art pallets and conventional wood pallets for moving or storing goods. One of principal purposes of this invention is to provide a pallet that is made from lightweight and low cost paper materials, yet because of its simple modular form is easy and cost-effective to produce. The low cost of paper, honeycomb and corrugate materials results in a low cost pallet thereby providing a low cost alternative to conventional wood pallets particularly for the moving or storage of lightweight goods.

Another object of this invention is to provide a design that possess strength approaching that of a traditional pallet with both the load-bearing capacity and side-shifting or shear strength of a wood pallet. The strength of the design comes from the honeycomb top deck and honeycomb legs or runners with the corrugate top sheet and runner or leg trays providing overall integrity to the design. Because of the top sheet and honeycomb top deck, the honeycomb legs that can run the entire length of the pallet deck only occupy a portion of the undercarriage of the pallet thereby allowing room for the forks of forklift to maneuver and pick up the load.

Another advantage is to provide a pallet that is protected against forklift operator damage. Although the honeycomb legs have high anisotropic strength, i.e., in directions parallel to the planes of the top and bottom sheets the structure is weak but the strength in a direction perpendicular to the sheets is high. By covering the honeycomb legs structure with a corrugate tray, the honeycomb structure of the legs is protected from fork damage caused by the forklift operator when inserting the forks to lift the load. In this regard, because the leg trays are tied to the top deck via the top sheet, the pallet design posses increase ability to handle shear stress imposed on the pallet when the forklift operator tries to side-shift the pallet, i.e. slide the pallet across the floor. Moreover, because the honeycomb legs do not occupy a high proportion of the area beneath the top deck, additional space is available for accompanying the forks of the forklift. This give the forklift operator additional room to maneuver the forklift forks beneath the deck. If the forks do penetrate the leg tray the overall integrity of the design is maintained. Because loads of 2000 to 2,500 pounds are easily stored and transported on this design, the load bearing capability of this invention approaches that of a traditional wood pallet.

Another object of the invention is to provide a pallet that can be used once or repeatedly. Since these pallets can be made relatively cheaply, they can simply be replace after one-trip or when damaged, saving on expensive repairs. Yet, the pallet is durable enough to be used more than one occasion. When the pallet is damage, because of its paper construction can be recycled rather than disposed of to a land fill. This feature is important to companies that are already recycling their paper and corrugate waste.

Another object of the invention is to provide a pallet design that can be made to the size desired. Because of the simple, modular design the pallet design can be greatly varies in both size and strength characteristics to accommodate the particular application of use of the pallet.

Another purpose of the invention is to provide a pallet that can be protected against water. The corrugate skin of the pallet may be plastics coated or otherwise waterproofed so that the resulting pallet has resistance to rain when stored outdoors or to water condensation present in a truck or train boxcar. The pallets can be impregnated by spraying or dipping the pallet in a water repellant chemical.

DESCRIPTION OF THE INVENTION

Figure 2:
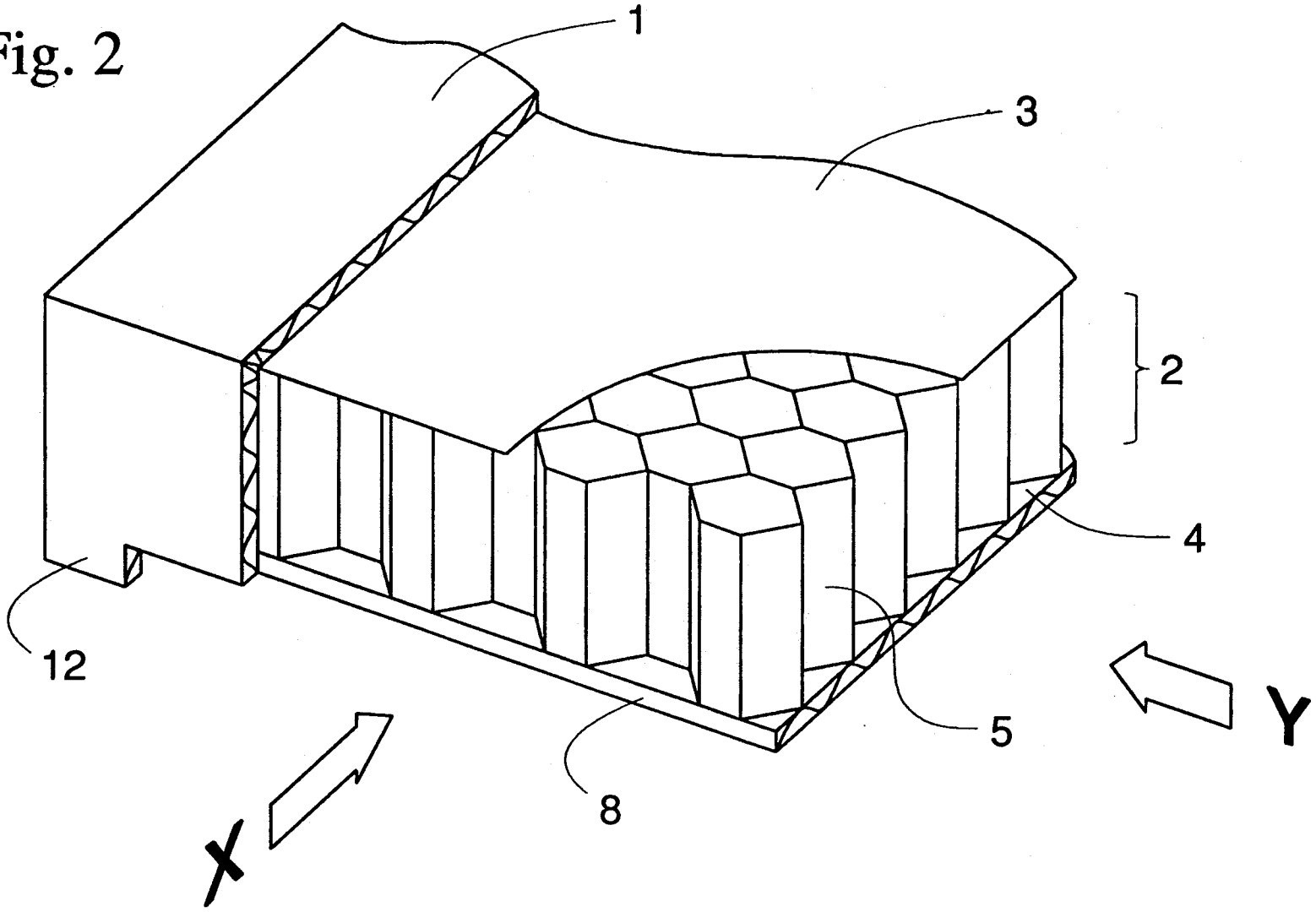
FIG. 2 shows a perspective view of a pallet top deck assembly displaying the corrugate top sheet, the honeycomb top deck and the bottom sheet.

For a better understanding of the invention, reference will now be made to the accompanying drawings. Referring to FIGS. 1 and 2, the pallet shown consist of a corrugate top cover sheet 1, a top deck 2 consisting of upper 3 and lower 4 skins of paper adhered to either side of an expanded honeycomb core 5, runners 6 enclosed in a corrugate cover tray 7 and adhered to the under side of the bottom sheet 8, each runner consisting of upper 9 and lower 10 skin of paper adhered to side of an expanded honeycomb core 11. The number, width and length of the legs may be varied to suit the particular use.

Referring to FIG. 2, the top deck of the pallet covered by the top sheet 1 is wrapped over the top deck 2 with tabs 12 to tie the runners and leg trays to the top deck. A corner of one of the top deck assembly has been broken away in the drawing to show the honeycomb structure. The honeycomb structure is formed of strips of paper or card glued together. The structure is secured between the face sheets 4 and 5 with adhesive. Adhesive can be applied to an inner surface of a face sheet or the top of the cell structure before the face sheets and open cellular structure of the honeycomb are glued together. The top deck assembly provides a smooth and unbroken surface for supporting a load. The pallet is rectangular in configuration usually somewhat longer than wide (e.g., 48 inches long by 40 inches wide).

Figure 3:
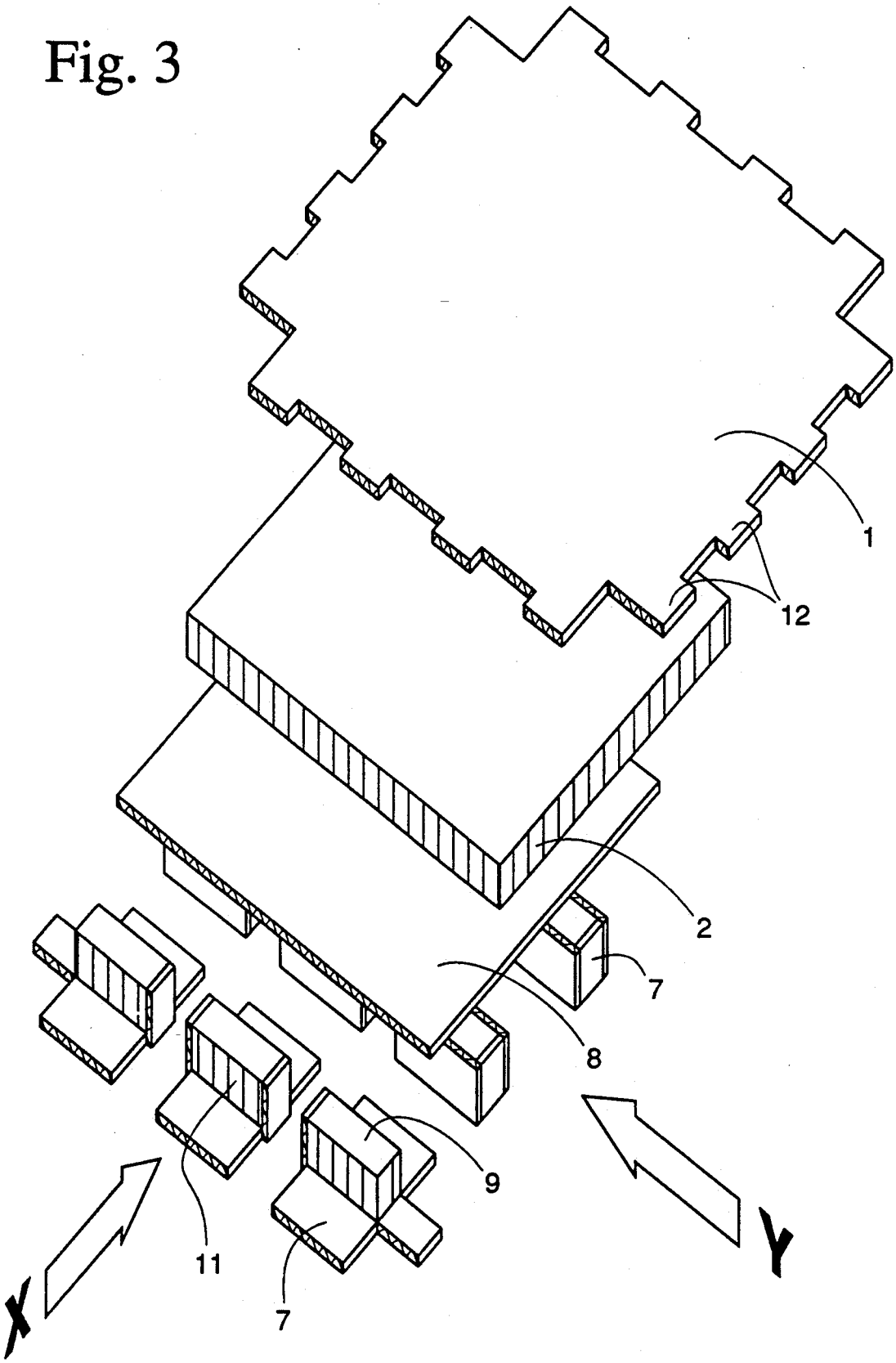
FIG. 3 shows a perspective vie of partially erected top sheet, top deck, bottom sheet, honeycomb legs and leg trays in position just prior to construction of the pallet.

Referring to FIG. 3, the design is broken apart to visualize assembly of the pallet. This figure displays a series of three legs for both ends and middle of the pallet. This design is typical of a four-way entry whereby the forks of the forklift or handjack can enter from either the x or y direction. As in FIG. 1, the legs are enclosed in a leg tray made form paper corrugate. The honeycomb core 11 of the leg is glued to the leg cover tray 7 and the entire assembly is glued to the underside of the deck, i.e., to the bottom sheet 8.

In place of the honeycomb open structure shown in the figures, similar cellular structure with cells or other cross-sectional shapes, such as slacked corrugate may be used as supporting material. In addition, corrugate paperboard can be used to form the core structure of the leg or runners. Where corrugate sheets provide the support structure of the leg, the corrugate sheets are glued together and stacked, optionally stacked parallel to the surface of the deck to give the necessary height require for the pallet. Either the corrugate or the cellular structure of the honeycomb provides a uniform support so as to transmit the load-bearing weight from the deck to the leg trays. The height of the legs are typically from two (2) to four (4) inches in height which provides enough elevation to enable the forks of the forklift to be maneuvered under the pallet load. The width of the legs are typically from three (3) to six (6) inches in order to provide adequate surface area to transfer the weight of the load to the floor while at the same time adding dimensional stability to the pallet.

Pallets by design are either two-way entry or four-way entry. A four-way entry pallets as shown in FIG. 3 has openings at both pallet ends and along pallet sides sufficient to admit the forks of a handjack or a forklift. Whereas the pallet of FIG. 1 displays a two-way entry design, i.e., a pallet allowing entry only from the ends (or from opposite sides only).

In the embodiment of FIG. 1, in order to allow the pallet to be used in conjunction with a roller conveyor systems, a hard paperboard is glued to the bottom of the runner tray 7. This paperboard is typically one-quarter ($\frac{1}{4}$) to one-half ($\frac{1}{2}$) inch in thickness and made from thin sheets of paper glued and compressed together to give a hard surface to the bottom of the runners. The hard surface prevents the bottom of the corrugate trays from depressing around the conveyor roller and preventing he load-bearing pallet from easily rolling down the conveyor. The paperboard provides adequate hard surface to reduce the compression of the runner and therefore reducers the drag on the pallet.

It may be desired that the pallet of FIGS. 1 or 3 be waterproofed. Once assembled the pallet can be sprayed on or dipped into a water-based or oil-based solution that will impart waterproofing.

Within the scope of the appended claims, it will be obvious to those skilled in the art that many permutations of the invention may be fabricated and assembled by varying the thickness of the top deck, the core structure of the runners or legs, the overlapping top sheet, etc. This invention is intended to cover all changes and modifications of the invention which do not constitute departures from the spirit and scope of the invention.

I claim:

1. A paper pallet comprising:

a lower corrugate sheet adherent to an lower surface of a honeycomb deck, a generally rectangular honeycomb deck having an upper and a lower surface and four edges comprising a central paper honeycomb core, an upper corrugate sheet adherent to the upper surface of the honeycomb deck and having a portion folded over the edges of the honeycomb deck covering those edges and having tabs extending downwardly from the honeycomb deck edges to overlap and to adhere to a of a leg, said leg having a top and sides, the top of which leg is adherent to the lower corrugate sheet and which lower corrugate sheet is in turn adherent to the lower surface of the honeycomb core, and a multiplicity of legs each comprising an expanded paper leg core having an upper face, a lower face, and sides and having a corrugate leg cover folded about the expanded paper leg core in such a way that the corrugate leg cover is in contact with and adheres both to the leg core sides and to the leg core lower face and the portion of the upper corrugate sheet covering the honeycomb core edge and the leg core upper face is adherent to the lower corrugate sheet.

2. The paper pallet of claim 1 in which the legs each comprise an expanded paper core having a corrugate tray folded about the expanded paper core.

3. The paper pallet of claim 2 in which the expanded paper leg cores comprise paper honeycomb.

4. The paper pallet of claim 2 in which the expanded paper leg cores comprise corrugate.

5. The paper pallet of claim 2 in which the legs extend substantially from one edge of the honeycomb deck to an opposite edge of the honeycomb deck.

6. The paper pallet of claim 2 in which the legs are situated at least at the junctions of the edges of the honeycomb deck.

7. The paper pallet of claim 1 which has been treated to increase water resistance.

8. A paper pallet comprising:

a lower corrugate sheet adherent to an lower surface of a honeycomb deck, a generally rectangular honeycomb deck having an upper and a lower surface and four edges comprising a central paper honeycomb core and upper, an upper corrugate sheet adherent to the upper surface of the honeycomb deck and having a portion folded over and extending downwardly from the upper surface of the honeycomb deck to cover the edges of the honeycomb deck, and a multiplicity of legs each comprising an expanded paper leg core having an upper face, a lower face, and sides and having a corrugate leg cover with tabs, said corrugate leg cover folded about the expanded paper leg core in such a way that the corrugate corrugate leg cover is in contact with and adheres both to the leg core sides and to the leg core lower face, the corrugate leg cover tabs extend upwardly and adhere to the portion of the upper corrugate sheet covering the honeycomb core edge, and the leg core upper face is adherent to the lower corrugate sheet.

9. The paper pallet of claim 8 in which the expanded paper leg cores comprise paper honeycomb.

10. The paper pallet of claim 8 in which the expanded paper leg cores comprise corrugate.

11. The paper pallet of claim 8 in which the legs extend substantially from one edge of the honeycomb deck to an opposite edge of the honeycomb deck.

12. The paper pallet of claim 8 in which the legs are situated at least at the junctions of the edges of the honeycomb deck.

13. The paper pallet of claim 8 which has been treated to increase water resistance.

* * * * *